US006864741B2

(12) United States Patent
Marsh et al.

(10) Patent No.: US 6,864,741 B2
(45) Date of Patent: Mar. 8, 2005

(54) LOW NOISE RESISTORLESS BAND GAP REFERENCE

(76) Inventors: Douglas G. Marsh, 1031 Graham St., Bethlehem, PA (US) 18015-2520; Apparajan Ganesan, Sanders Estes Unit, 1100 Highway 1807, Venus, TX (US) 76084

( * ) Notice: Subject to any disclaimer, the term of this patent is extended or adjusted under 35 U.S.C. 154(b) by 0 days.

(21) Appl. No.: 10/314,470

(22) Filed: Dec. 9, 2002

(65) Prior Publication Data

US 2004/0108887 A1 Jun. 10, 2004

(51) Int. Cl.[7] ..... G05F 1/10
(52) U.S. Cl. ..... 327/539; 327/541; 323/315
(58) Field of Search ..... 327/540, 541, 327/542, 539; 323/315

(56) References Cited

U.S. PATENT DOCUMENTS

| | | | | |
|---|---|---|---|---|
| 4,897,595 A | | 1/1990 | Holle | 323/314 |
| 5,325,045 A | * | 6/1994 | Sundby | 323/313 |
| 5,434,532 A | | 7/1995 | Thiel | 327/531 |
| 5,568,045 A | | 10/1996 | Koazechi | 323/314 |
| RE35,951 E | | 11/1998 | Ganesan | 323/313 |
| 5,867,012 A | | 2/1999 | Tuthill | 323/313 |
| 6,031,350 A | | 2/2000 | Sidey | 318/599 |
| 6,288,525 B1 | | 9/2001 | Fischer | 323/313 |
| 6,307,426 B1 | | 10/2001 | Rossi | 327/543 |
| 6,346,802 B2 | | 2/2002 | Bagnalasta | 323/313 |
| 6,614,209 B1 | * | 9/2003 | Gregoire, Jr. | 323/316 |
| 2002/0070793 A1 | * | 6/2002 | Ochi | 327/539 |

OTHER PUBLICATIONS

Buche, McDonald, Lewis, Viswanathan, Jan. 2002, IEEE Journal of Solid State Circuits, vol. 37, #1, ACMOS, Band gap reference without resistors, p 81–83.

* cited by examiner

*Primary Examiner*—Terry D. Cunningham

(57) ABSTRACT

The junction difference used for a band gap voltage reference is designed so that it has the needed temperature coefficient without amplification. This is accomplished by the appropriate choice of the number of junctions and the appropriate current densities. Only one polarity of bipolar transistors is required. The noise terms of each junction add in root mean square, rather than be linear amplification, resulting in a lower noise reference than other designs requiring only a single type of bipolar transistors. By using metal available in standard integrated circuit processes to form a resistor, a low temperature coefficient current source can easily be obtained.

11 Claims, 5 Drawing Sheets

Fig 1 – Prior Art

LOW NOISE RESISTORLESS BAND GAP REFERENCE

CROSS-REFERENCE TO RELATED APPLICATIONS

Not applicable.

BACKGROUND

1. Field of Invention

This invention relates to integrated circuit band gap reference sources, specifically, to a design that requires only one polarity of bipolar transistor and does not require any resistors.

2. Description of Prior Art

Numerous patents have been issued for band gap reference voltages, the most basic implementation of which is shown in FIG. 1. This design is well known and will be reviewed here only very briefly. In designs of this type, a differential base-emitter voltage drop is generated across a pair of bipolar junctions, and this difference is amplified by a resistor ratio. The resultant voltage has a positive temperature coefficient. This resultant voltage is then added to a junction voltage, which has a negative temperature voltage. By well known means the positive temperature coefficient is set to equal the negative temperature coefficient, and the result is a voltage with very small temperature variation.

A more recent example based on the principles of the design of FIG. 1 using a multiplicity of junctions on each side of the amplifier is found in U.S. Pat. No. RE35,951.

Because the initial differential voltage drop is amplified by the resistor f ratio, any noise associated with the voltage, including noise from the circuits which bias them up, is similarly amplified.

A recent U.S. Pat. No. 6,288,525, does not require any resistors. In this design, noise is the root mean square sum of the noise of multiple junctions, rather than the amplification of a few junctions, so output noise is less than that of earlier designs. However, this design requires both PNP and NPN transistors. In standard lowest cost CMOS processes, PNP transistors with the collector tied to the substrate require no special processing. To obtain an NPN transistor, a BiCMOS process is typically used, increasing cost.

In a recent publication (IEEE Journal of Solid State Circuits, January 2002, page 81–83), another design is reported that does not need resistors. However, the basic design makes use of a small differential voltage drop amplified by ratios of MOS transistors. This approach requires an inverse current function based on long channel MOS transistor theory. The differential voltage is converted to a current, amplified by MOS transistor rations, and converted back to a voltage. Any noise associated with the transistors used to develop the differential voltage, including noise from the circuits which bias them up, is similarly amplified.

Another recent U.S. Pat. No. , 6,614,209, also does not require resistors. However, this design is based on using a cascade of proportional to absolute temperature (PTAT) voltage generators, each having its own differential amplifier. Each differential amplifier adds to the die area and to the total noise.

Trimming a band gap reference is typically done by adjusting a resistor. Such trimming requires substantial die area for good matching. Furthermore, the fusible links used to control the trimming typically are used to turn MOSFET switches on or off. These MOSFET switches are typically in series with resistors that form series and parallel connections of resistors. Consequently, the on resistance of the switch must be very small with respect to the resistors so that the resistance of the switch can be ignored. This requires physically large switches, using considerable die area. An alternative method buffers the output voltage with an operational amplifier and trims the gain of the amplifier. While this does not require large switches, it does require additional resistors and the amplifier. An alternate method of trimming is disclosed in US Patent Application Publication 2002/0070793, and this method can be applied to the invention described herein.

SUMMARY

In accordance with the current invention, the junction voltage difference used for a band gap voltage reference is designed so that it has the needed temperature coefficient without amplification. This is accomplished by the appropriate choice of the number of junctions and the appropriate current densities. Only one polarity of bipolar transistors is required. The noise terms of each junction add in root mean square, rather than by linear amplification, resulting in a lower noise reference than other designs requiring only a single type of bipolar transistors. By using metal available in standard integrated circuit processes to form a resistor, a low temperature coefficient current source can easily be obtained.

OBJECTS AND ADVANTAGES

Accordingly, several objects and advantages of this invention are:

(a) resistors are not used;

(b) only one polarity of bipolar transistors is required;

(c) noise is less than previous band gap voltage references using only one polarity of bipolar transistors;

(d) invertible functions of current and voltage are not-required; and (e) a low temperature coefficient current source is easily obtained.

DRAWING FIGURES

FIG. 1 shows an example of the prior art from U.S. Pat. No. 6,288,525.

DESCRIPTION—PREFERRED EMBODIMENT

Figure 2:
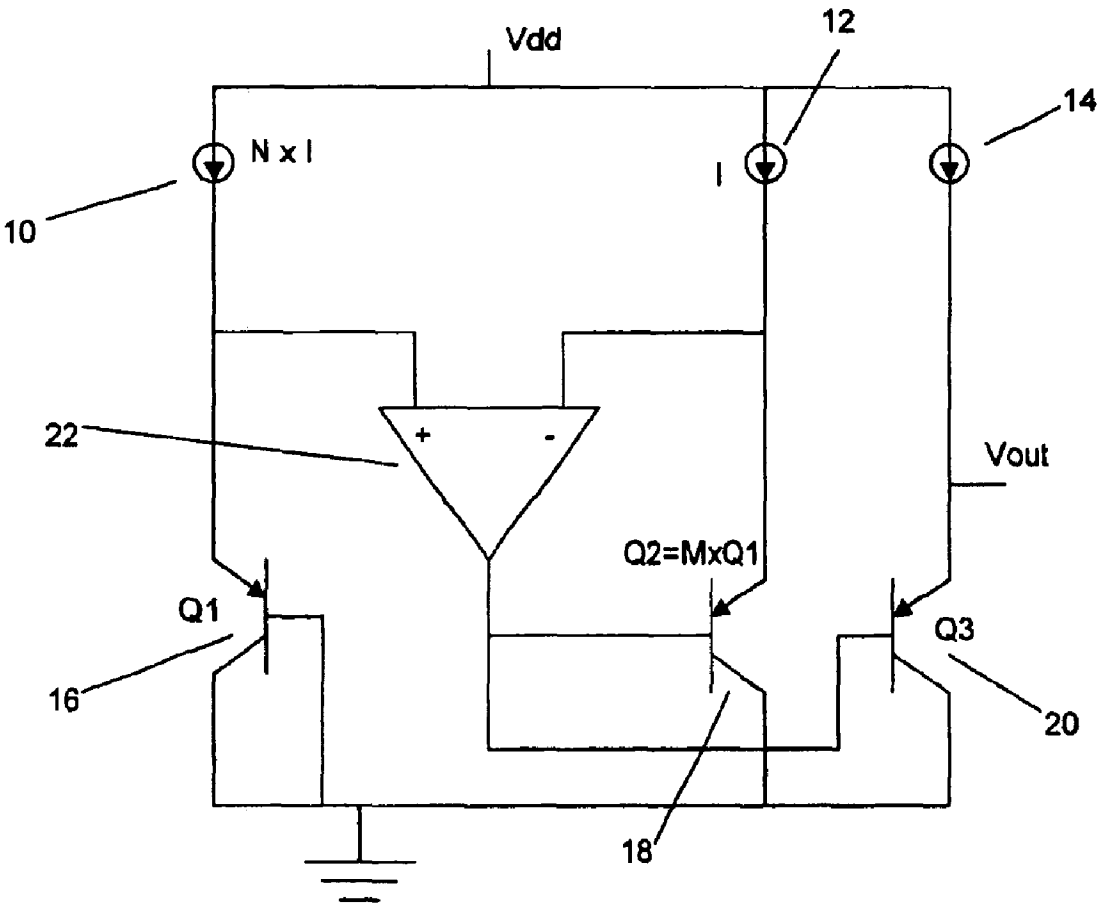
FIG. 2 shows the basic concept of the invention wherein no resistors and only one polarity of bipolar transistor are used.

The basic concept of the invention is shown in FIG. 2. A first current source 10 is N times bigger than a second current source 12. A first bipolar transistor Q1 16 and a second bipolar transistor Q2 18 are in a 1:M size ratio. The result is that the current density in the first bipolar transistor 16 will be N×M larger than in the second bipolar transistor 18. Those skilled in the art will immediately recognize that amplifier 22 forces the emitters of transistor 16 and transistor 18 to be at essentially equal potentials with respect to the base of transistor 16, shown here connected to ground. This forces the base of the transistor 18 to be approximately (kT/q)×ln(N×M) volts higher than the base of the transistor 16. Therefore, the output voltage will be the combination of this voltage added to the base-emitter voltage of a third bipolar transistor Q3 20 which is biased from a third current source 14.

$$Vout=Vbe(Q3)+(kT/q)\times\ln(N\times M)$$

It is well known that the base-emitter voltage of transistor Q3 20, Vbe(Q3), has a negative temperature coefficient while the (kT/q)×ln(N×M) term has a positive temperature coefficient. By the proper choice of N×M, the temperature coefficient can be set very close to zero. Designers of conventional band gap voltage references commonly use this principle, but the N×M factor is not sufficient to give correct temperature variation compensation. Instead the (kT/q)×ln(N×M) term is amplified by a ratio of resistors to achieve temperature compensation.

Those skilled in the art know that the bipolar transistors can be either PNP or NPN. For purposes of simplicity and because PNP substrate transistors are commonly used in CMOS band gap references, this embodiment is shown with PNP substrate bipolar transistors.

By considering typical values, it will become clear why N×M is not set to the above value. The temperature coefficient of Vbe(Q3) is approximately −1.8 mV per degree C. kT/q is approximately 25 mV at room temperature, and it has a temperature coefficient of 25 mV/T=0.085 mV per degree C. at room temperature. Therefore, ln(N×M)=1.8/0.085=21.2 is needed to get temperature coefficient cancellation. This gives N×M=1.6E9, which is unrealizable in a practical design.

Figure 3:
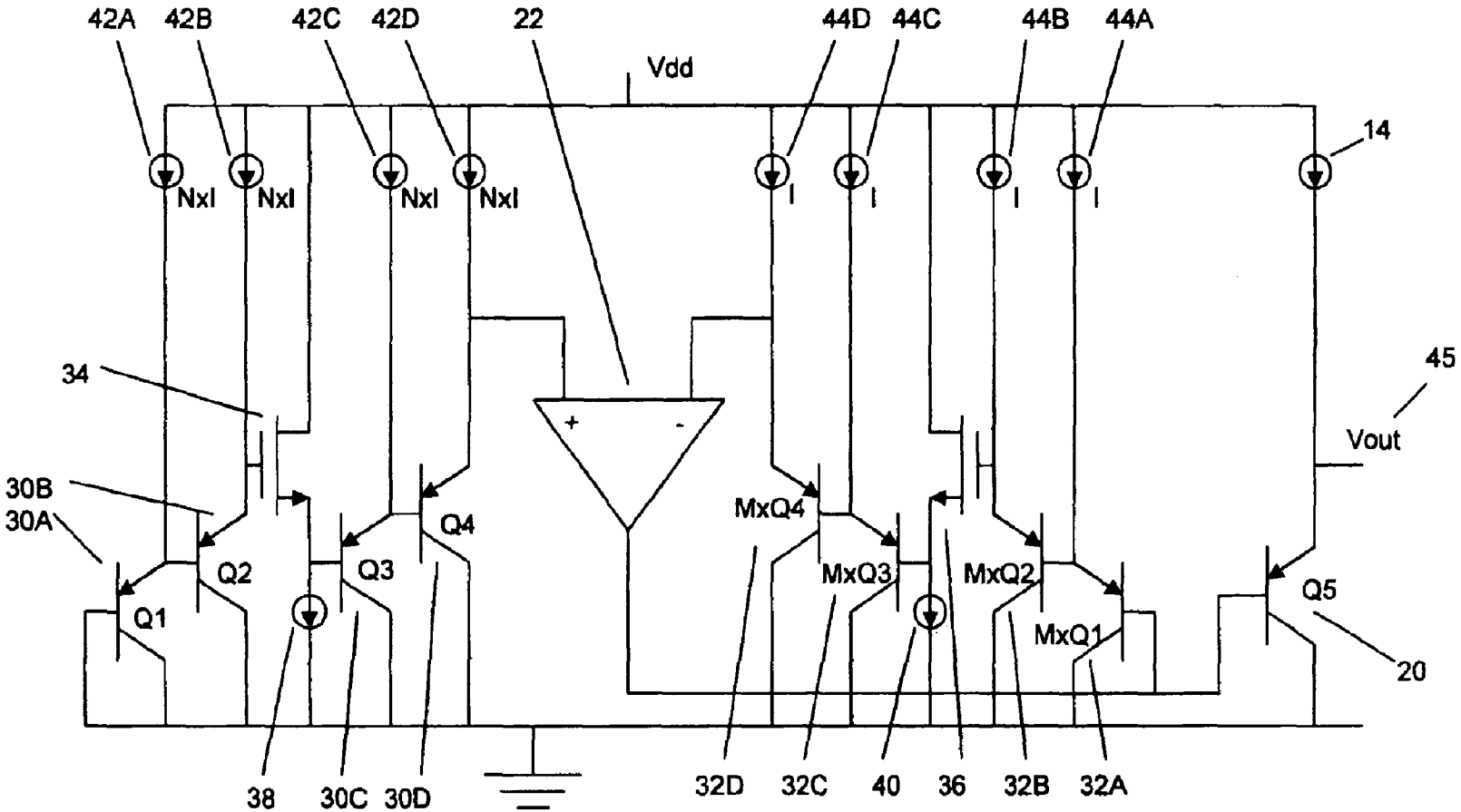
FIG. 3 shows a practical embodiment of the invention.

FIG. 3 shows a practical embodiment of the design of FIG. 2. Instead of just one high current density transistor 16 and one low current density transistor 18, a plurality of high and low current density bipolar transistors 30A–D, 32A–D are used. In a standard CMOS process, these transistors typically use the P-type substrate material as the collector (see US Patent Application Publication 2002/0070793 for an example). The substrate is typically tied to the reference, or ground, voltage of the circuit, and the output voltage of design is typically measured with respect to this reference. Such an arrangement ensures that the bipolar transistors are all in their normal linear operating range because the base-to-collector voltages of all the bipolar transistors 30A–D, 32A–D, are all at zero volts or are revered biased. Those skilled in the art understand that it is permissible to allow the base-to-collector diodes to become somewhat forward biased without effecting the linear operation of the transistors. Therefore, in a more complex process, such as a BiCMOS process, it would be permissible to tie the collectors to some other node, so long as that node can sink the required current and so long as the bipolar transistors 30A–D, 32A–D, remain in the linear region of operation.

To reduce power supply voltage requirements, we show level shifters 34, 36 and their current sources 38, 40. Those skilled in the art will recognize that the level shifters allow the differential offsets on the bipolar transistors to add to the desired voltage while the common mode voltage is maintained at a low level. Level shifters 34, shown here are NMOS FETs, so it is preferred that they should have the same W/L and their current sources 38, 40 should have the same current. By designing them in this way, they do not introduce any additional differential voltage drop or temperature coefficient. It is evident that the highest voltages in this circuit are the inputs to the amplifier 22 which are at 4Vbe−Vgs, where Vgs is the gate source voltage of the level shifters 34, 36.

In the preferred embodiment shown in FIG. 3, one pair of MOSFET level shifters 34, 36 and their associated current sources 38, 40 are placed following a pair of two base-emitter voltages 30A, 30B, 32A, 32B on each side. This arrangement achieves the lowest common mode voltage at the input to the amplifier 22 in a typical CMOS process. However, threshold voltage can be changed within a CMOS process, so the specific placement of these level shifters can be selected by the designer based on the process used and other design considerations such as current density and mismatch in the level shifters.

Figure 1:
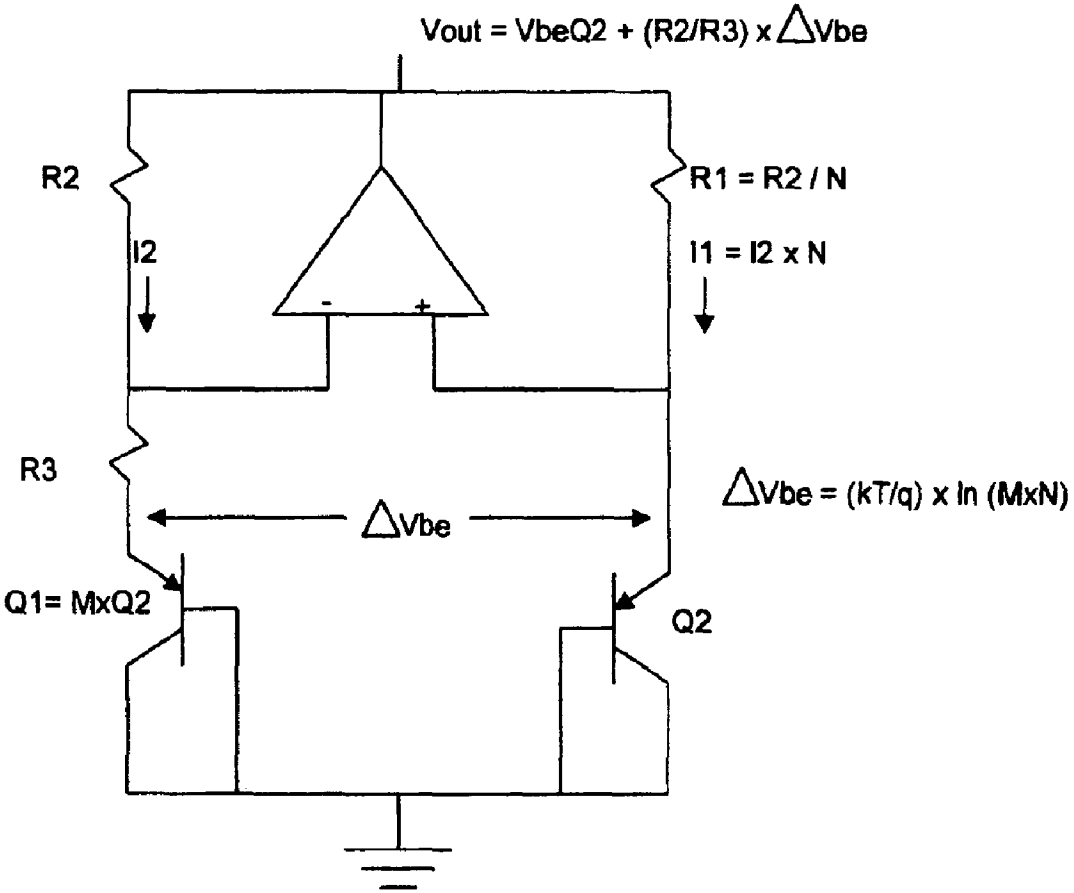

The currents to transistors 30A–D from current sources 4042A–D are a factor of N times larger than the currents to transistors 32A–D from current sources 44A–D. In the preferred embodiment, all current sources are MOSFETs, but in a BiCMOS process, bipolar transistor current sources could be used. Transistors 32A–D are made M times larger than transistor 20A–D. This results in the voltage at the base of transistor 20 being four (4) times higher than the circuit of FIG. 1. Therefore Vout 45 is given by $$Vout=Vbe(Q5)+4\times(kT/q)\times\ln(N\times M)$$

This reduces ln(N×M) to 5.29 and N×M to 199. By adding one more stage of level shift and transistors, the maximum voltage at the inputs to the amplifier 22 is increased to 6Vbe−2Vgs and the N×M factor becomes 34.

Those skilled in the art know that there are other factors, including temperature variations in the current sources that will affect overall performance. These are commonly dealt with in prior art. One simple approach is to set the N×M factor to a value needed to compensate for those effects.

The transistors and current sources on a given side of the amplifier 22 are all shown the same size. Those skilled in the art will also realize that that it is not necessary to maintain such equal sizing. This flexibility can be used in design optimization.

In addition to the elimination of the resistor or FET transistor ratios used to amplify the differential base emitter voltage drop, the resultant noise of the band gap is reduced. In order to understand this, compare the prior art in FIG. 1 to this invention. In the case of a single differential Vbe drop in FIG. 1 amplified as needed to get proper temperature compensation, the noise of the two transistors is also amplified. For illustrative purposes, assume that the above derived factor of 34 for N×M is used for both the prior art reference and for this invention using the six transistor per side configuration. The gain for the prior art to get the temperature coefficient cancellation is $$1.8/(0.085\times\ln(34))=6$$

The noise becomes $$Vn^2=6^2\times(vn1^2+vn2^2)+vn3^2+voa^2=36\times(vn1^2+vn2^2)+vn3^2+voa^2$$

where $vn1^2$ is the noise of one of the differential transistors, $vn2^2$ is the noise of the other differential transistor, $vn3^2$ is the noise of the third transistor used to generate the output voltage and $voa^2$ is the noise of the amplifier. For simplicity, the noise of the current sources biasing those transistors can be lumped in with the transistor noise voltages. Contrast this to the noise of the circuit in FIG. 3, except with the six bipolar transistors on each side, with currents to be the same as in the prior art case. All individual noise terms are the same:

$$Vn^2=6\times(vn1^2+vn2^2)+vn3^2+voa^2$$

Those skilled in the art will immediately recognize that the above noise analysis does not include all noise sources. In the prior art case, the resistor noise is omitted. Such terms are generally negligible compared to other sources. The level shifters and their bias currents may be important terms in the new invention that have been omitted. The level shifters will add noise, but because they are all matched, they can be designed to operate in a region where their noise does not add significantly to the overall performance. Typically, this means at least a few tenths of a volt above threshold.

It is a design optimization task to properly bias the level shifters to optimize noise, minimizing power supply voltage requirements, and keep current sources well matched. It is not required that the structure be a string of two bipolar devices and a level shift transistor. However, meeting the requirement of biasing the level shifters 34,36 a few tenths of a volt above threshold results in beginning the chain with a stack of two, 30A–B,32A–B. This enables current sources 38, 40 biasing the level shifters 34,36 to be kept well matched.

Figure 4:
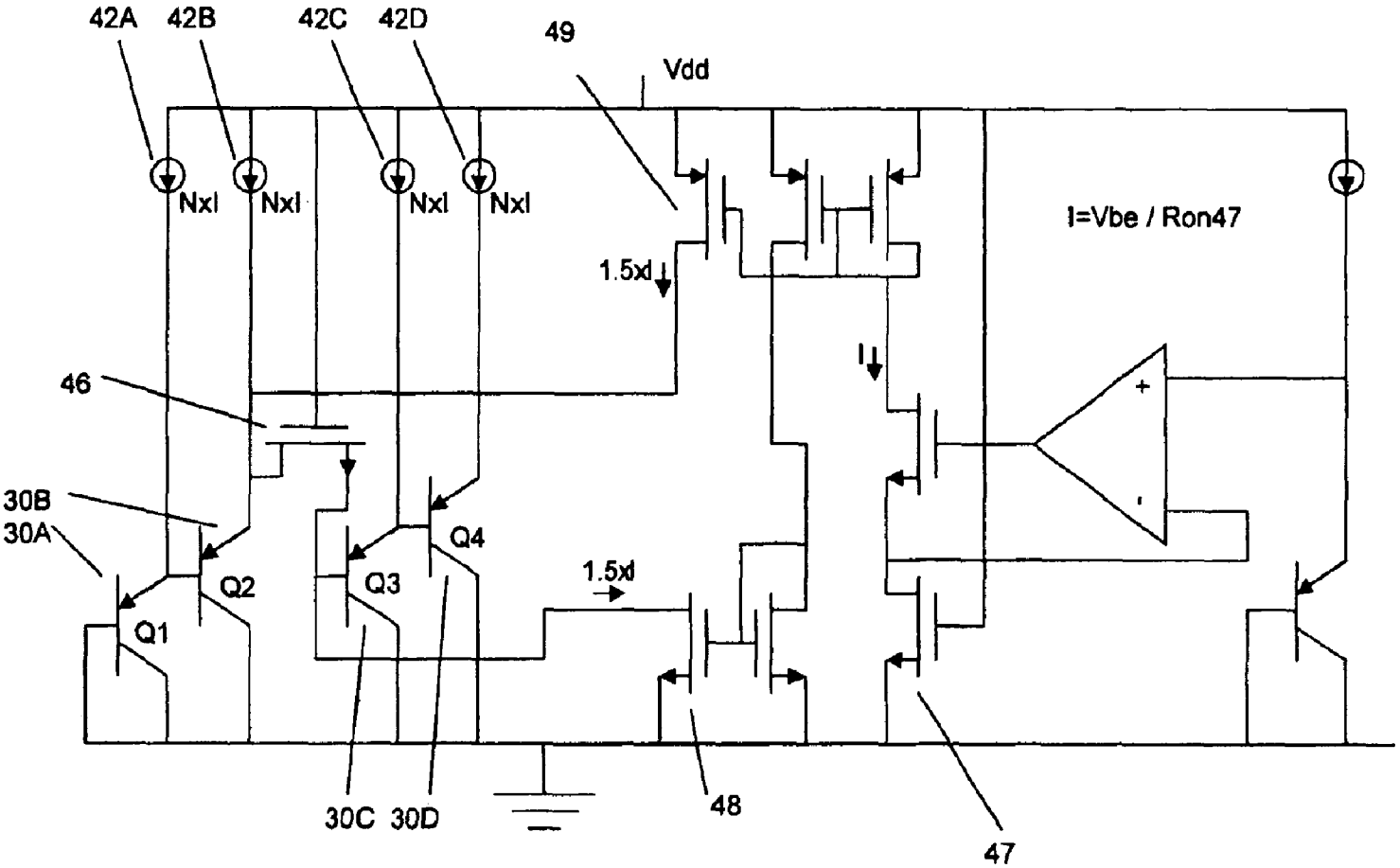
FIG. 4 shows a level shift proportional to a base-emitter junction voltage.

Those skilled in the art will recognize that NMOS FETs are not the only means of level shifting that could be used in the FIG. 3 circuit. For example, in FIG. 4, one half the diode array is shown. Similar level shifting would be done on the other side. Level shift transistor 38 is replaced by level shift transistor 46. The drain and gate of the level shift transistor 46 is reversed from those of level shift transistor 38. Transistors 46 is in its triode mode, and the voltage drop across it is its on-resistance times the current in the current source transistor 48. An equal current is applied to the drain side of transistor 46 from current source transistor 49. Using such an approach, it would be preferred to have the level shift track a diode voltage drop. In FIG. 4, current sources 46,48 are shown 1.5 times the reference current in transistor 47 so that the level shift is 1.5 times a base-emitter voltage drop. This further reduces the overall common mode range. Choices such as this will be made by the designers based on design needs and current source designs. Such a level shift approach could also be used between other emitter-base connection nodes as another way to limit the overall common mode voltage. Of course, a conventional resistor could replace the MOS device, but this would require resistor capability in the process. Yet another level shifter would be to replace the NFETs in our preferred embodiment with PFETs. The PFETs would have their gate and drain tied to the base of transistors 30C,32C and their sources tied emitters of 30B,32B.

Due to manufacturing variations, it is well known that there will be variations in the output voltage 45. These variations are small but some means of trimming them out is essential. A buffer amplifier with a variable gain could be used, but this requires resistors, and the intent of this design is to eliminate the use of resistors. Alternately, the method of US Patent Application Publication 2002/0070793 can be directly utilized. This ensures that this invention can produce a high precision output voltage. One method of performing this Such trimming is shown in FIG. 5. IOUT represents the current sources 30A–D,32A–D. By scaling transistor 52 in each trim block 50A–C, weighted trim currents flow out of IT and add to IOUT when DTNA-C 58A–C are low. When DTNA-D 58A–C are high, no trim current flows from its respective trim block 50A–C. Logic inverter 51 and FET switches 55 and 57 act in well know ways in concert with DTNA-D 58A–C to control that current flow. Typically, the weighting is binary. It is a design optimization task to determine the trim weights, trim algorithm, and matching requirements. It is common practice to make the current sources 3042A–D,44A–D from a multiplicity of MOS transistors. By digital control, gates on some elements of this plurality are connected to a reference gate and the gates of the others are connected to the positive power supply voltage. This changes the current and current density into the bipolar transistors.

Those skilled in the art will recognize that means of improving power supply rejection ratio, such as generating the local power supply, labeled Vdd in the figures, of this invention by feed back means from the output voltage can be done by well known means used in other band gap references. Such circuits generally require additional circuitry for ensuring startup.

Figure 6:
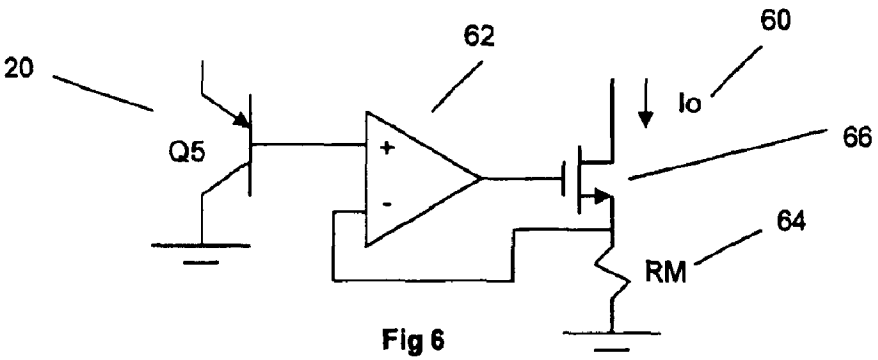
FIG. 6 shows a means of obtaining a low temperature coefficient current source.

In addition to producing a band gap voltage source, a low temperature coefficient current source can be readily obtained. FIG. 6 shows and output current Io 60 made by applying the base of transistor 20 (Q5) shown in FIG. 3 to a well known current source structure made from an operational amplifier 62, a resistor 64 (RM), and a buffer transistor 66. The invention here is that by making resistor RM 64 from metal material normally found in standard integrated circuits, the resulting current output Io 60 has a very low temperature coefficient. This metal material is typically a sandwich of several elements selected by the process developers. Typically, aluminum is the dominant material. To understand how the low temperature coefficient is obtained, examine the equation for the current:

$$Io=[4\times(kT/q)\times\ln(N\times M)]/RM$$

The numerator varies with absolute temperature, T, and this is a temperature coefficient of about 3000 ppm/C. The sheet resistance of metal normally used in integrated circuit processes has a temperature coefficient also of about 3000 ppm/C. Therefore, Io 60 will have a low temperature coefficient. Io 60 will, of course, vary with process variations according to variations in the metal sheet resistance. A typical cause of this variation is the thickness of the metal. The temperature coefficient of the metal does not vary significantly as the thickness changes.

Other materials are available within a standard CMOS process for making resistor RM. These include the P-type and N-type materials used to for the drains and sources of the FETs and any wells within which these FETs are formed. Also, the polysilicon used for the gates can also be used as formed for the gates or further doped with P-type or N-type material. However, the resulting resistors in a modern process typically have temperature coefficients below 1200 ppm/C, and this does not match the temperature coefficient of the voltage, so the current would not have a very low temperature coefficient. Within the structure of the resistorless band gap voltage generator described in this invention, no voltages exist with a temperature coefficient near that of any of the other readily available resistors.

Figure 5B:
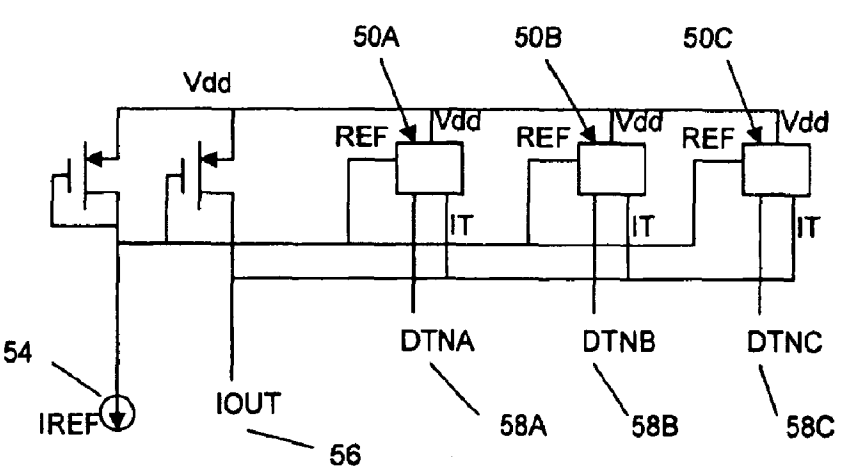
FIG. 5 shows one means of trimming currents.
Figure 5A:
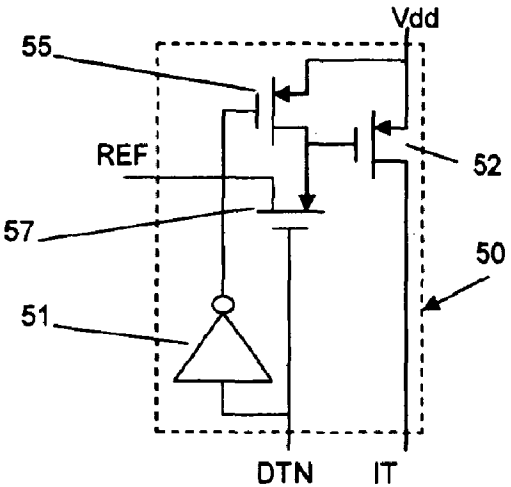

Trimming means such as already discussed and shown in FIG. 5 can be applied to this current source to compensate for metal sheet resistance variation. In this case. Io 60 is the IREF 54 in FIG. 5*b*, and the digital controls DTNA, DTNB, and DTNC 58A,B,C are used to adjust the current Iout 56. One application for such a current source would be to apply it to a capacitor as part of a timing circuit. Other applications will be apparent to designers skilled in the art.

Other means of generating the output current are possible. One such method would be to simply replace the N-FET 66 with a P-FET. In this case, the drain of the P-FET would connect to resistor RM and the source of the P-FET would be the output current. Current mirrors in parallel with this P-FET or in series with its source would make the current available wherever it is to be used. In this case, those skilled in the art will recognize that the P-FET and resistor RM form an additional stage of inverting gain to the feedback of the amplifier 62. Therefore, the base of Q5 20 must be tied to the negative input of the differential amplifier and the feedback from resistor RM must be applied to the positive input. The added gain of the P-FET and resistor RM stage may require changing the compensation of the amplifier, as those skilled in the art will immediately recognize.

Advantages

From the description above, a number of advantages of this method of automatic meter reading become evident:

(a) no resistors are used;

(b) only the bipolar transistor readily available is standard CMOS is needed;

(c) the resultant noise is lower than in designs using linear amplification;

(d) invertible functions of current and voltage are not required; and (e) a low temperature coefficient current source is easily obtained.

Conculsions, Ramifications, and Scope

Accordingly, it is evident that this invention offers a band gap voltage that can be implemented without using resistors, using only the bipolar transistor available from a standard integrated circuit process, and having lower noise than designs made with the same technologies. By using metal available in standard integrated circuit processes to form a resistor, a low temperature coefficient current source can easily be obtained.

We claim:

1. An electronic circuit comprising:

a plurality of bipolar transistors, the first having its base connected to a reference, the following ones forming a series connection with their bases connected to the emitter of the preceding ones, and the collectors connected to a potential capable of supplying the current needed while maintaining the bipolar transistors in their linear region;

MOSFET level shifters inserted between some of the base to emitter connections with a gate connected to the emitter, a source connected to the base and a drain connected to a potential capable of supplying the current at which the MOSFETs are biased, the type of MOSFET chosen to reduce the overall operating voltage of the circuit;

a second plurality of bipolar transistors operating with lower current densities than the first plurality and connected in the same fashion as in the first plurality, and with level shifters connected in the same fashion as in the first plurality and operating at the same current densities as the level shifters in the first plurality;

a differential amplifier with its positive input terminal connected to the emitter of the last transistor in the first plurality, its negative input connected to the emitter of the last transistor in the second plurality, and its output connected to the base of the first transistor in the second plurality;

a transistor whose base is connected to the output of the amplifier and whose emitter is the output node of the circuit, and current sources biasing all the transistors.

2. An electronic circuit in accordance with claim 1 wherein all the bipolar transistors and PNP type and the MOSFET level shifters are N-channel transistors.

3. An electronic circuit in accordance with claim 2 wherein all current sources driving the emitters are P-channel MOSFETs and all current sources driving the level shifter MOSFETs are N-channel MOSFETs.

4. An electronic circuit in accordance with claim 3 whereby the temperature coefficient of the output voltage is adjusted very close to zero by choice of the size of the bipolar transistors and the currents applied to them.

5. An electronic circuit in accordance with claim 3 providing trimming means for adjusting the current densities in the bipolar transistors whereby the output voltage is adjusted to compensate for manufacturing variations.

6. An electronic circuit in accordance with claim 1 wherein the MOSFET level shifters inserted between some of these base to emitter connections with the drain connected to the emitter, the source connected to the base and the gate connected to some other appropriate potential sufficient to place this transistor in the non-saturation region of operation, the type of MOSFET chosen to reduce the overall operating voltage of the circuit.

7. An electronic circuit in accordance with claim 1 wherein the MOSFET level shifters inserted between some of these base-to-emitter connections with the source connected to the emitter and the gate and drain connected to the base, the type of MOSFET chosen to reduce the overall operating voltage of the circuit.

8. An electronic circuit in accordance with claim 6 wherein the current flowing through the level shift MOSFET is designed such that the level shift voltage tracks the base-to-emitter voltage drop and may be an integer or non-integral multiple of that base-emitter voltage drop.

9. An electronic circuit composed of a combination of an electronic circuit according to claim 1, the output of the differential amplifier having a variation proportional to absolute temperature, wherein said voltage is applied to other electronic circuitry, said other electronic circuitry further comprising:

an input to said additional circuitry being the positive input of a second differential amplifier, said applied voltage being applied to the positive input of said second differential amplifier;

the output of said second differential amplifier is applied to the gate of a MOSFET transistor, the source of said MOSFET transistor is connected to one terminal of a resistor and to the negative input of said second differential amplifier;

the second terminal of said resistor is connected to a reference said transistor having a temperature coefficient that is approximately proportional to absolute temperature;

and the current at the drain of said MOSFET transistor is the output current;

whereby said output current is produced with low temperature variation.

10. An electronic circuit in accordance with claim 9 providing trimming means for adjusting the value of the current to compensate for variation in metal sheet resistance due to processing variations.

11. An electronic circuit composed of a combination of an electronic circuit according to claim 1, the output of the differential amplifier having a variation proportional to absolute temperature, said voltage is applied to other electronic circuitry, said other electronic circuitry further comprising: input to said additional circuitry being the positive input of a second differential amplifier, said applied voltage being applied to the negative input of said second differential amplifier;

the output of said second differential amplifier is applied to the gate of a MOSFET transistor, drain of said MOSFET transistor is connected to one terminal of a resistor and to the positive input of said second differential amplifier;

second terminal of said resistor is connected to a reference said resistor having temperature coefficient that is approximately proportional to absolute temperature;

and the current at the source of said MOSFET transistor is the output current;

whereby said output current is produced with low temperature variation.

* * * * *